US006878265B2

(12) United States Patent
Didillon et al.

(10) Patent No.: US 6,878,265 B2
(45) Date of Patent: Apr. 12, 2005

(54) PROCESS FOR CAPTURING MERCURY AND ARSENIC IN A DISTILLED HYDROCARBON CUT

(75) Inventors: Blaise Didillon, Francheville (FR); Carine Petit-Clair, Montesson (FR); Laurent Savary, Rueil-Malmaison (FR)

(73) Assignee: Institut Francais du Petrole, Puteaux (FR)

( * ) Notice: Subject to any disclaimer, the term of this patent is extended or adjusted under 35 U.S.C. 154(b) by 399 days.

(21) Appl. No.: 09/754,321

(22) Filed: Jan. 5, 2001

(65) Prior Publication Data

US 2002/0139721 A1 Oct. 3, 2002

(30) Foreign Application Priority Data

Jan. 7, 2000 (FR) ..... 00 00248

(51) Int. Cl.[7] ..... C10G 29/00

(52) U.S. Cl. ..... 208/251 R; 208/253; 208/251 H; 585/820

(58) Field of Search ..... 208/251 R, 253, 208/251 H; 585/820

(56) References Cited

U.S. PATENT DOCUMENTS

| | | | | |
|---|---|---|---|---|
| 4,911,825 A | | 3/1990 | Roussel et al. | 208/251 R |
| 5,062,948 A | * | 11/1991 | Kawazoe et al. | 208/251 R |
| 5,384,040 A | * | 1/1995 | Mank et al. | 208/251 R |
| 5,401,392 A | | 3/1995 | Courty et al. | 208/251 H |
| 5,601,701 A | | 2/1997 | Cameron et al. | 208/251 H |
| 5,989,506 A | | 11/1999 | Markovs | 423/210 |
| 6,033,556 A | * | 3/2000 | Didillon et al. | 208/253 |
| 6,149,799 A | * | 11/2000 | Raybaud et al. | 208/49 |

FOREIGN PATENT DOCUMENTS

| | | |
|---|---|---|
| FR | 2 644 472 | 9/1990 |
| FR | 2 698 372 | 5/1994 |

* cited by examiner

*Primary Examiner*—Nadine G. Norton
(74) *Attorney, Agent, or Firm*—Millen, White, Zelano & Branigan, P.C.

(57) ABSTRACT

A process for eliminating mercury and possibly arsenic from a hydrocarbon feed comprises:

1) distilling the hydrocarbon feed to obtain at least one light cut and at least one heavy cut;
2) treating at least one said heavy cut, said treatment comprising two steps
   a first step bringing said heavy cut into contact with hydrogen and a catalyst;
   a second step consisting of passing the effluent from the first step over a mass for capturing mercury and possibly arsenic.

14 Claims, 2 Drawing Sheets

PROCESS FOR CAPTURING MERCURY AND ARSENIC IN A DISTILLED HYDROCARBON CUT

The invention relates to a process for eliminating mercury and possibly arsenic from a hydrocarbon feed, comprising a step for distilling the feed and then (a) at least one two-step mercury capture stage (a catalytic decomposition step and a mercury adsorption step) carried out on at least one of the distillation cuts, and (b) at least one gas or liquid phase demercurisation step carried out on at least one of the cuts.

Liquid condensates (by-products from gas production) and certain crude oils are known to contain a variety of metallic trace compounds, usually in the form of organometallic complexes. Such metallic compounds are usually poisons for the catalysts used in processes for transforming such cuts into commercial products. Mercury is particularly toxic to the activity of precious metals present and it is also highly corrosive towards aluminium parts, seals and welds.

It is thus advantageous to purify feeds for sending to processes for transforming condensates or crudes to avoid entraining mercury and possibly arsenic Purification of the feed upstream of treatment processes can protect the whole of the facility.

The Applicant has already proposed a process for eliminating mercury from hydrocarbons acting as feeds for a variety of treatment processes. The Applicant's U.S. Pat. No. 4,911,825 describes the importance of capturing mercury and possibly arsenic using a two-step process. The first step consists of bringing the feed, in the presence of hydrogen, into contact with a catalyst comprising at least one metal selected from the group formed by nickel, cobalt, iron and palladium. The mercury is not (or is only slightly) captured by the catalyst but it is activated on that catalyst so as to be captured in a second step by a mass comprising sulphur or sulphur-containing compounds.

In a further example, the Applicant's French patent application FR-A-92 14224 describes a two-step process as described above but with a step for distilling the feed after the first step. The metallic mercury from the first step is then distributed into different cuts, and the light fractions are enriched and are then treated with a metallic mercury adsorption mass, as described above.

In a still further example, Japanese patent JP-103377 describes a process comprising a first feed heat treatment step carried out at a temperature of more than 200° C. to decompose all of the mercury species present in the feed to mercury metal, which is then adsorbed onto a metal sulphide.

The Applicant's U.S. Pat. No. 4,094,777 describes a process for capturing mercury in its metal form, in the gas or liquid phase using an adsorbent mass constituted by a metal sulphide.

The present invention enables the above techniques to be used in combination. Instead of directly treating the feed with one or other of the methods described above, it has been discovered that by first distilling the feed to obtain a variety of cuts, the mercury (and any arsenic) is distributed differently in these cuts. In general, the metallic mercury is more concentrated in the lightest cut(s), while the mercury compounds (mainly organometallic compounds) are concentrated in the heaviest cut(s) while the sludge is essentially in the heaviest cut.

Thus, the invention provides a first step for distilling the treated feed, at temperatures in the range between the initial point and the end point of the feed in question. These temperatures are in the range 20° C. to 600° C. Unlike that described in JP-103377, the aim here is not to decompose the orgyanomercuric compounds into mercury metal, but to distil into a variety of cuts, which, however, can decompose a good proportion thereof.

Thus, prior fractionation of the above feeds to be demercurised can concentrate a large proportion of the metallic mercury in the lightest cuts. An increase in the mercury concentration has been observed in the light cuts after the fractionation step, the mercury being obtained by decomposition of organometallic mercury compounds or by thermal decomposition of sludges in which mercury is present. A reduction in the mercury concentration has been observed in the heaviest cuts, to the benefit of the lightest cuts, which are enriched in mercury.

More precisely, a particular distribution of mercury in the distillation effluents has now been discovered. The transformation of various mercury compounds to elemental mercury by the distillation step leads to a substantial increase in the mercury concentration in the light cuts and to a reduction in the concentration of metallic mercury in the heavy cuts. This change in the mercury distribution is completely unexpected since the boiling point of mercury metal is 356° C., and the mercury should be concentrated in the heavy fraction. However, distillation cannot decompose all of the species of mercury to metallic mercury, thus non-metallic mercury species remain in concentrated form in the intermediate cuts.

Further, this distillation step has the advantage of concentrating particles in suspension, known as sludge and formed from solid mineral compounds (silica . . . ) and/or heavy hydrocarbons in the condensed form, in the heaviest portion of the distillate, in which the mercury which was present in the metallic form or organometallic form has been decomposed under the effect of temperature.

The invention thus concerns a process for eliminating mercury and possibly arsenic from a hydrocarbon feed, the process comprising.

(1) Prior distillation (or fractionation) of said hydrocarbon feed leading to a variety of cuts. This distillation is carried out in a temperature range generally in the range from about 120° C. to 500° C. depending on the nature and properties of said feed.

(2) Demercurisation (and possibly dearsenification) carried out on at least one of the heaviest cuts, said demercurisation being carried out in two steps.

(a) a first step comprising bringing the heavy cut into contact with a catalyst in the presence of hydrogen. This step transforms the mercury organometallics to activate the mercury (or arsenic). In an advantageous example, it is possible to use the Applicant's process described in U.S. Pat. No. 4,911,825, consisting of bringing the feed into contact, in the presence of hydrogen, with a catalyst comprising at least one metal from the group constituted by nickel, cobalt, iron and palladium. The mercury is not (or is only slightly) captured by the catalyst but it is activated on this catalyst so as to be captured in the second step described below by a mass comprising, for example, sulphur or sulphur-containing compounds;

(b) a second step consisting of passing at least a portion of the effluent from the first step over a mercury capture mass comprising, for example, sulphur and/or at least one sulphur-containing compound, i.e., of passing said effluent from the first step over at least one adsorbent based, for example, on a metal sulphide deposited on a support. Advantageously, the technique described in the Applicant's U.S. Pat. No. 4,094,777 can be used;

(3) and optionally, adsorption of mercury contained in at least one of the lightest cuts. This adsorption is carried out on an adsorbent or capture mass comprising, for example, sulphur and/or at least one sulphur-containing compound, for example another adsorbent based on a metal sulphide deposited on a support. Here again, the method described in the Applicant's U.S. Pat. No. 4,094,777 is used.

EXAMPLE 1

Figure 1:
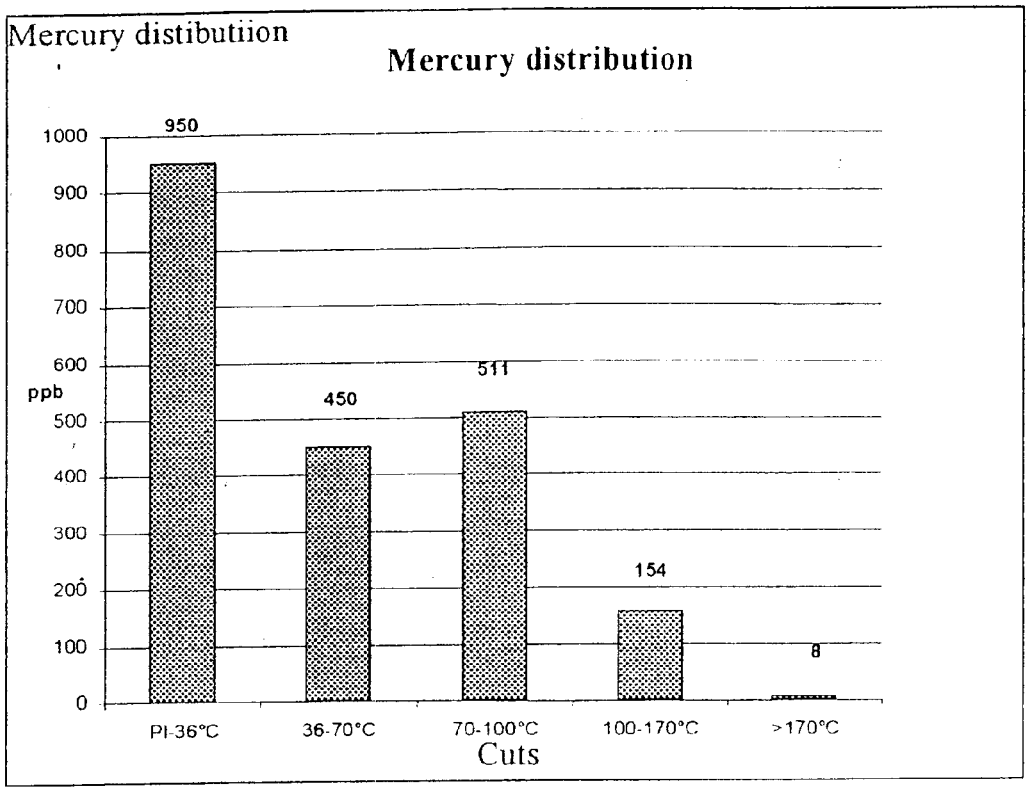
FIG. 1 is a graphical depiction of mercury distribution in five cuts of a distilled feed.
Figure 2:
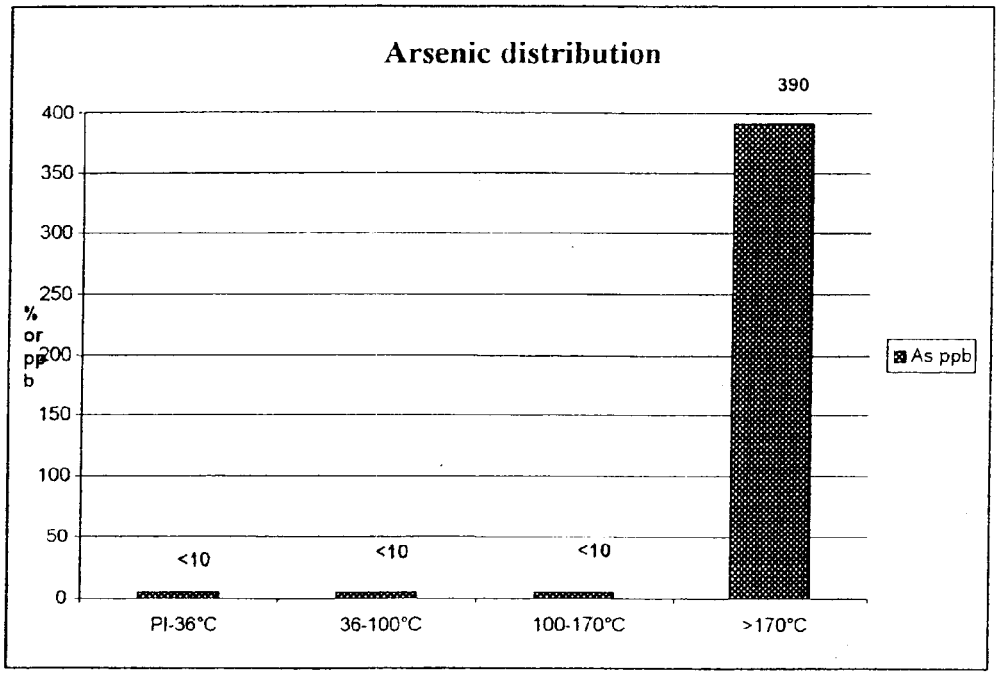
FIG. 2 is a graphical depiction of arsenic distribution in five cuts of a distilled feed.

The distilled feed was a condensate with respective mercury and arsenic contents of 500 and 200 ppb and a sludge content of 2000 ppm (containing 1% to 5% of mercury). The feed was distilled into five cuts and the mercury and arsenic distributions are shown in FIGS. 1 and 2.

An accurate analysis of the mercury species present in these different cuts produced the following distribution:

| Cuts | IP-36° C. | 36–70° C. | 70–100° C. | 100–170° C. | >170° C. |
|---|---|---|---|---|---|
| Types of mercury | Hg° | Hg° | Hg° | OM* | OM* |

*OM signifies organometallic mercury compounds

Demercurisation of these cuts thus requires installing a simple metallic mercury adsorber for the cuts containing metallic mercury, as described in the present invention In contrast, the heaviest cuts (>100° C.), which cuts contain organometallic mercury compounds but also arsenic (see FIG. 2) will thus be decontaminated by installing a two-step purification unit, as described in the present invention.

Further, after distillation, the sludge present in the feed, also containing mercury, is found in the heaviest cut (>170° C. in the example) and is also completely demercurised.

EXAMPLE 2

Figure 3:
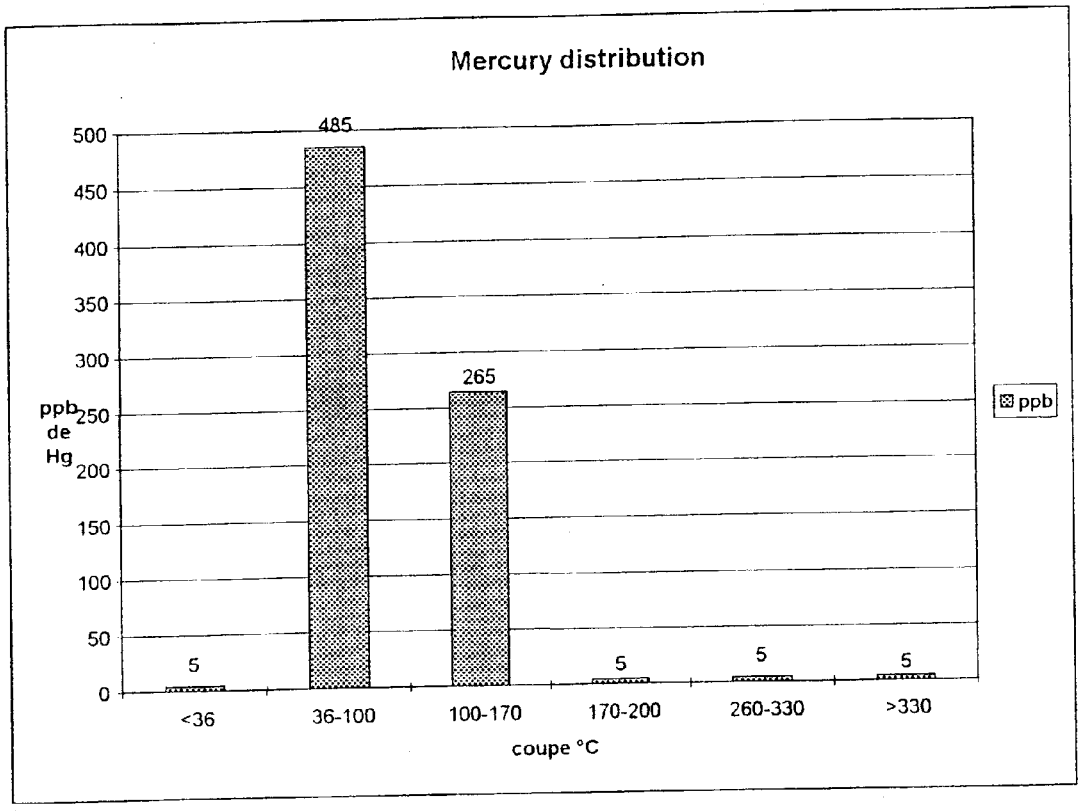
FIG. 3 is a graphical depiction of mercury distribution in five cuts of a condensate.

The following example used the method of Example 1 to distil a further condensate, containing only mercury but in an amount of 1500 ppb. The distribution of mercury in the different cuts is shown in FIG. 3.

Analysis of the mercury compounds in the different cuts showed the exclusive presence of metallic mercury. Installing a simple mercury adsorber in each of these cuts produced a demercurisation efficiency of more than 99%.

What is claimed is:

1. A process for eliminating mercury and optionally arsenic from a liquid condensate by-product from gas production wherein said liquid condensate has not been subjected to prior conversion of organomercuric compounds to elemental mercury, said process comprising first distilling said liquid condensate under such conditions as to partially decompose said organomercuric compounds to elemental mercury and simultaneously to obtain at least one light cut and at least one heavy cut, said at least one light cut having a higher concentration of elemental mercury than that of said at least one heavy cut and treating said at least one heavy cut by bringing said heavy cut into contact with hydrogen and a catalyst, and passing the resultant effluent over a mass for capturing mercury and optionally arsenic.

2. A process according to claim 1 further comprising passing the at least one light cut over a mass for capturing mercury and optionally arsenic.

3. A process according to claim 1, wherein the catalyst comprises nickel, cobalt, iron or palladium.

4. A process according to claim 1, wherein the mass for capturing mercury and optionally arsenic comprises sulphur or a sulphur-containing compound.

5. A process according to claim 1, wherein the mass for capturing mercury and optionally arsenic comprises at least one metallic sulphide deposited on a support.

6. A process according to claim 2, wherein the mass for capturing mercury and optionally arsenic over which said at least one light cut is passed comprises sulphur or a sulphur-containing compound.

7. A process according to claim 6, wherein the mass for capturing mercury and optionally arsenic comprises at least one metallic sulphide deposited on a support.

8. A process according to claim 1, wherein the distillation is carried out at 120° C. to 500° C.

9. A process according to claim 3, wherein the mass for capturing mercury and optionally arsenic comprises sulphur or a sulphur-containing compound.

10. A process according to claim 9 further comprising passing the at least one light cut over a mass for capturing mercury and optionally arsenic.

11. A process according to claim 10, wherein the mass for capturing mercury and optionally arsenic over which said at least one light cut is passed comprises sulphur or a sulphur-containing compound.

12. A process according to claim 11, in which said mass for capturing mercury and optionally arsenic comprises at least one metal sulphide deposited on a support.

13. A process for eliminating mercury and optionally arsenic from a hydrocarbon feed comprising distilling the hydrocarbon feed to obtain at least one light cut and at least one heavy cut, and treating said at least one heavy cut by bringing said heavy cut into contact with hydrogen and a catalyst, and passing the resultant effluent over a mass for capturing mercury and optionally arsenic, and passing the at least one light cut over a mass for capturing mercury and optionally arsenic.

14. A process for eliminating mercury and optionally arsenic from a liquid condensate by-product from gas production according to claim 1, said process further comprising directly passing the at least one light cut over a mass for capturing mercury and optionally arsenic.

* * * * *